US006249297B1

(12) United States Patent
Lion

(10) Patent No.: US 6,249,297 B1
(45) Date of Patent: Jun. 19, 2001

(54) PROCESS FOR CONTINUOUSLY PRINTING A PLASTIC FILM, DEVICE FOR CARRYING OUT THE PROCESS AND PRINTED PLASTIC FILM OBTAINED BY THE PROCESS

(75) Inventor: Jean-Pierre Lion, Laval (FR)

(73) Assignee: Societe d'Enduction et de Flockage, Laval (FR)

( * ) Notice: Subject to any disclaimer, the term of this patent is extended or adjusted under 35 U.S.C. 154(b) by 0 days.

(21) Appl. No.: 09/418,987

(22) Filed: Oct. 14, 1999

(30) Foreign Application Priority Data

Oct. 14, 1998 (FR) ..... 98 12862

(51) Int. Cl.[7] ..... B41J 2/315
(52) U.S. Cl. ..... 347/171
(58) Field of Search ..... 427/271; 347/171; 156/324, 324.4, 277, 234, 238, 241

(56) References Cited

U.S. PATENT DOCUMENTS 5,552,183 9/1996 Killar ..... 427/271

FOREIGN PATENT DOCUMENTS 0 097 528 1/1984 (EP) .
0 637 268 7/1996 (EP) .
WO 93/22072 11/1993 (WO) .
WO 98/24643 6/1998 (WO) .

*Primary Examiner*—N. Le
*Assistant Examiner*—K. Feggins
(74) *Attorney, Agent, or Firm*—Young & Thompson

(57) ABSTRACT

Process for continuously printing a plastic film includes the steps of applying to the back of the plastic film a temporary anti-sticking support, heating the assembly of the plastic film and the temporary support to a temperature such that the plastic film reaches its softening point to stick temporarily to the temporary sport, transferring by sublimation a design constituted by a sublimable ink pre-printed on a printing paper, by contact under predetermined temperature and pressure with the front of the plastic film therm-stuck to the temporary support, and cooling the assembly of the thus-printed plastic film and of the temporary support to a temperature permitting unsticking the temporary support.

13 Claims, 3 Drawing Sheets

PROCESS FOR CONTINUOUSLY PRINTING A PLASTIC FILM, DEVICE FOR CARRYING OUT THE PROCESS AND PRINTED PLASTIC FILM OBTAINED BY THE PROCESS

BACKGROUND OF THE INVENTION

The invention relates to a process for continuously printing a flat plastic film, flocked or not, the device for practicing the process and the printed plastic film obtained by this process.

The invention also relates to a process for continuously printing a colored or uncolored motif on a flat plastic film, flocked or not, adapted to be thermoformed to a predetermined non-planar surface, as well as the flat printed plastic film and the thermoformed plastic film obtained by this process.

Transfer printing by sublimation is already known as such and consists, in the first instance, in printing on a support paper designs from inks constituted by sublimable coloring agents which are adapted to vaporize at a certain temperature and to be fixed permanently on synthetic materials, for example polyester or polyamide polymers, the printing process of the support paper being adapted to be anything at all, for example offset printing, heliographic or flexographic printing, or again serigraphic printing by flat plate or rotary plate. Then, in the second instance, the designs in sublimable coloring agents, preliminarily imprinted on the support paper, are transferred by sublimation, by placing in contact, under a regulated pressure and at a predetermined temperature, generally with the aid of hot rolls, the pre-printed paper with the textile support to be printed, generally for a duration of 5 to 40 seconds. The hot rolls can comprise, in the case of printing in formats, a hot press with horizontal plates, or in the case of continuous printing from rolls of printed paper and of synthetic material to be printed, a rotating heated cylinder associated with a belt rolling under tension.

However, transfer printing by sublimation is not adapted to print plastic films, for the following reasons:

- plastic films, and more particularly extruded films, have errors of flatness, which renders difficult their continuous printing, from a roll of plastic film,
- plastic films, and more particularly plastic films adapted to be thermoformed, such as polyvinyl chloride (PVC) films or polystyrene films, have a thermal sensitivity such that they melt and thus lose all cohesion, when they are subjected to impression by transfer by sublimation at a temperature of about 200° C., which gives rise to random dimensional fluctuation of the plastic film during printing whilst the pre-impregnated impression paper undergoes no deformation, thereby giving rise to blurred and irregular printing,
- the melting of the plastic film during printing also gives rise to sticking of the plastic film on the conveyor belt of the printing machine,
- the melting of the non-flocked plastic film also leads to sticking of the plastic film to the pre-printed printing paper.

This printing process by transfer by sublimation can be used to print certain plastic materials, if there is first applied a layer of glaze on the plastic material to be printed, or first treating the pre-printed printing paper so as to render it non-adhesive. This printing method is particularly used to print pieces of plastic that are injected or shaped, such as bottles, skis, pens, helmets, and in this case, the printing is carried out by means of a heating tool matching the shape of the plastic piece to be printed.

Another direct printing method for plastic films consists in using known processes of the flexographic or serigraphic type, but in this case, the ink does not penetrate the plastic material, such that the printing designs have low resistance to scraping and friction. Moreover, these printing processes do not permit obtaining the most detailed graphic effects, for example for color printing of the photographic type.

Still another known method to print plastic films consists in thermobonding on the surface to be printed of the plastic film a pre-printed support, for example polyester film printed by heliography, then hot counter-adhered to the plastic film at the outlet of the extruder.

On the other hand, when plastic films to be printed are adapted to be thermoformed, for example to form protective blocks, pieces for the automobile industry, elements for packing, printed designs on the flat plastic film subject the deformation of the plastic film on a non-planar surface, giving rise to a modification of the contours and of the configuration of the printed design, as well as a variation of the shade of the colors, because of the stretching of the plastic film during its thermoforming. When the design which must be given to the non-flat thermoformed surface is a geometric design, letters or numerals, the deformations of the design can be unacceptable.

SUMMARY OF THE INVENTION

The invention has for its first object to provide a continuous printing process of a plastic film, flocked or not, with transfer by sublimation, whilst having high quality, detail and sharpness of printing, for example of the four-color type, and avoiding any sticking between the plastic film and the conveyor belt or the pre-printed printing paper.

A second object of the invention is to provide a printing process for design on a flat plastic film, flocked or not, adapted to be thermoformed into a predetermined non-planar surface, which permits compensation for the deformations of the design and/or the variations of shade of the colors on the non-planar thermoformed surface.

To achieve the first-mentioned object, the invention has for a first object a continuous printing process of a plastic film, flocked or not, characterized in that it consists in:

- applying on the back of the plastic film a temporary anti-adherent support, for example of paper,
- heating the assembly of the plastic film and of the temporary support to a temperature such that the plastic film reaches its softening point to stick temporarily to the temporary support, such that this latter ensures the dimensional stability of the plastic film during the following thermal printing step,
- transferring by sublimation a design constituted by a sublimable ink pre-printed on a printing paper, by contact under pressure and at a predetermined temperature with the front of the plastic film thermo-held on the temporary support,
- cooling the assembly of the plastic film thus printed and of the temporary support to a temperature permitting the unsticking of the temporary support.

Preferably, the temperature to thermo-stick the plastic film to the temporary support is comprised between 100 and 200° C., preferably between 170 and 180° C. The temperature for transfer by sublimation can be comprised between 170 and 230° C. The temperature at which the assembly of the printed plastic film and the temporary support is cooled can be of the order of 20 to 30° C.

In one embodiment, the process of the invention consists, for a non-flocked plastic film, in pre-printing the printing paper with an ink containing sublimable coloring agents, with a low content of softening or anti-adherent agents, to avoid sticking between the plastic film and the impression paper, during the printing step by transfer by sublimation. The agents can be selected from silicones, organic fatty acids and chromium stearates.

In another embodiment, the process consists in preparing a flocked plastic film, by applying to the front of the plastic film an adhesive layer and flocking fibers of white color on said adhesive layer. Preferably, the adhesive layer is a polymer resin in aqueous emulsion or organic solution, and the flocks are preferably polyamide or polyester fibers, with a length comprised between 0.3 and 3.0 mm and a titre comprised between 0.5 and 20 Dtex (0.5 and $20.10^{-7}$ $Kg.m^{-1}$).

The plastic film can be a calendered, extruded or co-extruded film, selected from polymer resins of polyvinyl chloride base, polystyrene, polypropylene, acrylic butyl styrene (ABS), polyurethane, polyester, polycarbonate, polyamide or any mixture of these latter.

The printing paper can be printed by offset, flexographic, heliographic, serigraphic printing or by ink jet.

The invention also relates to the device for practicing the process described above, characterized in that it comprises:

an unwinding station, comprising a reel for a strip of plastic film, flocked or not, and a reel for a strip of temporary support, a heating station at the inlet of which the strip of temporary support is applied against the back of the strip of plastic film, the assembly constituted by said superposed strips coming into contact via the temporary support strip, against a heating drum driven in rotation, so as to deliver at the outlet a composite strip constituted by the plastic film thermo-stuck to the temporary support, a thermo-printing machine, comprising a conveyor belt under tension which comes into contact with the temporary support of said composite strip, a heating calender driven in rotation, and at least one reel for a strip of paper pre-printed with a design constituted by a sublimable ink, said strip of pre-printed paper being applied to the front of the plastic film of said composite strip, upstream of the heating calender, such that the conveyor belt can press with predetermined pressure said composite strip covered with pre-printed paper against the heating calender, to transfer by sublimation the sublimable ink to the front of the plastic film, the printing paper being separated from the printed composite strip downstream of the heating calender, a cooling station to cool the composite printed strip to a temperature such that the temporary support strip can be unstuck from the strip of printed plastic film, a reeling station at the inlet of which the temporary support strip is unstuck from the strip of printed plastic film, each strip being wound on a respective wheel which is driven in rotation.

Preferably, the cooling station comprises two double thickness cylinders, each cylinder comprising a circulation of a cooling agent, for example water, within the double thickness, such that said composite printed strip comes into contact with the first cylinder with its temporary support, then with the second cylinder with its strip of printed plastic film.

The invention also has for its object a strip of printed plastic film, characterized in that it is directly obtained by the mentioned process.

To achieve the second mentioned object, the invention has for a second object a continuous printing process of a design, colored or not, on a flat plastic film, flocked or not, adapted to be thermoformed into a predetermined non-planar surface, characterized in that it consists in:

geometrically dividing into elemental regions a portion of the flat plastic film to be thermoformed, determining for each elementary region of the film, the amount of local stretching of the film upon its thermoforming into the non-planar surface, determine for each elementary region of the film, a portion of the deformed design to be printed on the surface of the flat plastic film, this portion of the deformed design being defined by transformation by anamorphosis of the final design to be provided on the thermoformed non-planar surface, by taking account of the amount of local stretching of the plastic film by which one passes from the deformed portion of the design to the final portion of the design, printing on the surface of the portion to be thermoformed of the flat plastic film, the deformed design defined by the assembly of the portions of the deformed design determined by the preceding step.

Preferably, the process consists in determining, for each elementary region of the film, the shade of color of the portion of the deformed design, as a function of the shade of color desired in the final design and of the amount of local stretch of the film by which one passes from the portion of deformed design to the portion of final design.

According to another characteristic, the process consists in printing simultaneously on the portion of the flat film other than that which will be thermoformed, a reference mark to locate precisely the portion to be thermoformed of the flat plastic film. Said reference mark to be printed can comprise a line extending along one edge of the flat plastic film and a mark extending transversely from this line.

Preferably, the mentioned printing step of the flat plastic film consists in:

applying on the back of the flat plastic film a temporary anti-adherent support, heating the assembly of the flat plastic film and of the temporary support to a temperature such that the plastic film reaches its softening point to stick temporarily to the temporary support, such that this latter assures dimensional stability of the plastic film upon the succeeding thermal printing step, transferring by sublimation the pre-printed deformed design in reverse with a sublimable ink, onto a printing paper, by placing in contact under pressure and at a predetermined temperature said printing paper, with the front of the plastic film thermo-stuck to the temporary support, cooling the assembly of the flat plastic film thus printed and the temporary support to a temperature permitting unsticking the temporary support.

In one embodiment, the process of the invention consists, for an unflocked plastic film, in pre-printing the printing paper with an ink containing sublimable coloring agents, with a low content in softening or anti-adherent agents, to avoid sticking between the plastic film and the printing paper, during the step of printing by transfer by sublimation. These agents can be selected from silicones, organic fatty acids and chromium stearates.

In another embodiment, the process consists in preparing a flocked plastic film, applying on the front of the plastic film an adhesive layer and flocking fibers of white color on said adhesive layer. Preferably, the adhesive layer is a polymer resin in aqueous emulsion or in organic solution, and the flocks are preferably fibers of polyamide or polyester, with a length comprised between 0.3 and 3.0 mm and a titre comprised between 0.5 and 20 Dtex (0.5 and $20.10^{-7}$ Kg. $m^{-1}$).

The plastic film can be a calendered, extruded or co-extruded film, selected from polymer resins with a polyvinyl chloride base, polystyrene, polypropylene, acrylic butyl styrene (ABS), polyurethane, polyester, polycarbonate, polyamide or any mixture of these latter.

The printing paper can be printed by offset, flexographic, heliographic, serigraphic printing or by ink jet.

In the final step, the process of the invention consists in positioning laterally and transversely the portion of the surface to be thermoformed of the flat plastic film on the surface of which is printed the deformed design, face to face with the shape of the thermoforming tool, by means of the mentioned printed reference mark, and in thermoforming with said thermoforming tool alone said portion into a non-planar surface on which the final desired design appears. Preferably, the process consists in optically detecting the longitudinal line of the reference mark to guide laterally the flat plastic film and the transverse mark of the reference to stop, in the longitudinal direction, the flat plastic film with its portion to be thermoformed facing the contour of the thermoforming tool.

Preferably, the process consists in calculating the portions of the deformed design by computer and in pre-printing the impression paper by an ink jet printing machine controlled by said computer.

Printing by ink jet permits providing digitized printing under optimum conditions, to the extent it is not necessary to provide specific printing tools, such as cylinders, offset plates, serigraphic frames, and in which printing by ink jet can be directly controlled by the computer provided with software for computing deformations of the design.

The invention also relates to the printed plastic film with a thermoformed non-planar surface, characterized in that it is directly obtained by the mentioned process.

BRIEF DESCRIPTION OF THE DRAWINGS

Other objects, details, characteristics and advantages of the invention will be described in greater detail in the detailed description which follows, of a particular embodiment now preferred, of the invention, given solely by way of illustration and not limitation, with reference to the accompanying schematic drawings, in which.

DESCRIPTION OF THE PREFERRED EMBODIMENTS

Figure 1:
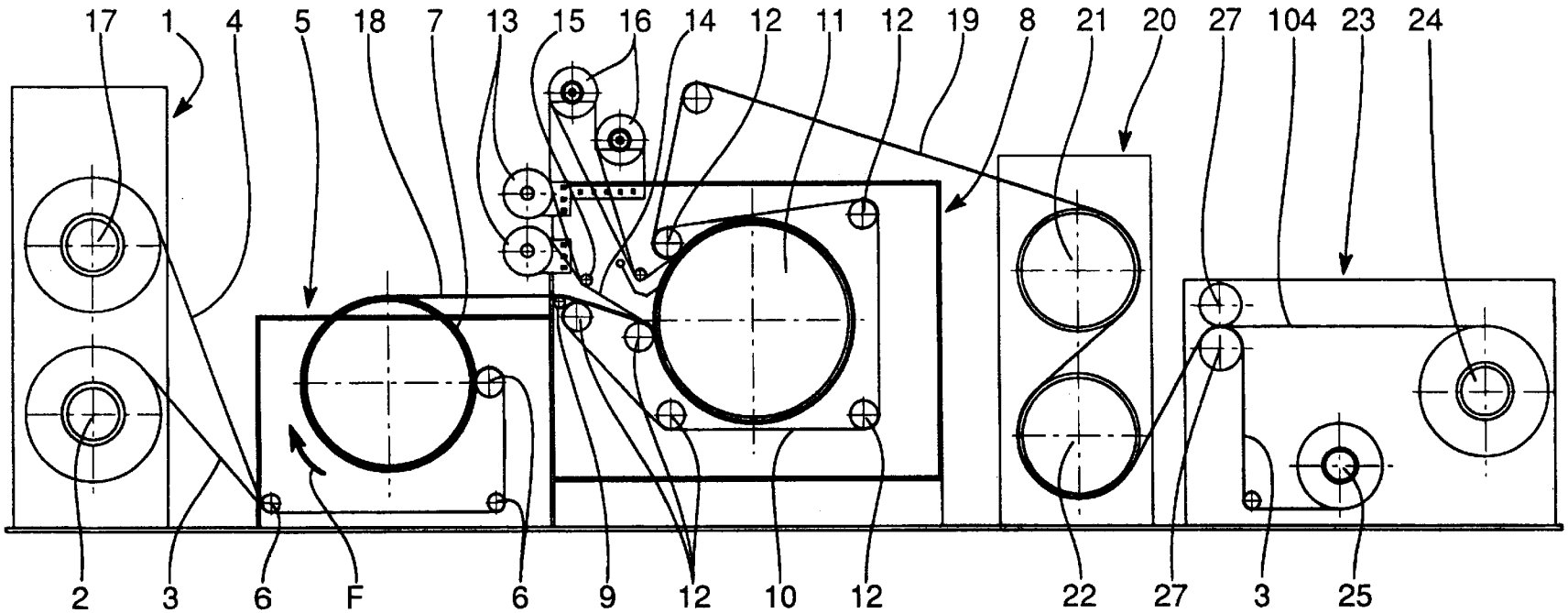
FIG. 1 is a schematic elevational view of an example of embodiment of the device for practicing the continuous printing process, according to the first object of the invention.

A particular example of embodiment of the device for practicing the continuous printing process of a plastic film by transfer by sublimation, will now be described with reference to FIG. 1.

This device comprises an unwinding station 1 which supports rotatably a reel 2 from which is unwound a strip of temporary support 3 for example of paper, and above the reel 2, a reel 17 from which is unrolled a strip of plastic film 4, flocked or not. The temporary support is of a material that is little sensitive to heat, so as to ensure a dimensional stability to the plastic film, during the ultimate operation of sublimation, this material having an anti-adhesive characteristic at ambient temperature, to facilitate the stripping off of the plastic film after thermoprinting, as well as the ability to adhere when hot to the plastic film when this latter is subjected to mounting, during ultimate operations of heating and transfer by sublimation.

The mentioned strips 3 and 4 then pass through a heating station 5 which comprises three guide rollers 6, arranged upstream of a rotatable heating drum 7, which is driven in rotation in the clockwise direction indicated by the arrow F in FIG. 1.

At the entry of the heating station 5, the strips 3 and 4 pass below a first roller 6, the front of the strip of plastic film 4 coming into contact with the roller 6 and the temporary support strip 3 coming into contact with the front of said strip 4. The assembly of the strips 3 and 4 thus proposed is brought horizontally to a second roller 6 against which continuously bears the front of the strip of plastic film 4, said strips 3 and 4 effecting a turn of 900 upwardly about this second roller 6. Then the superposed strips 3 and 4 carry out a turn of 180° about the third roller 6 which is located adjacent the heating drum 7, such that the temporary support strip 3 comes into contact with the heating cylinder 7, to avoid sticking by softening of the plastic film on the heating drum 7. The assembly of the strips 3 and 4 then passes about the heating drum 7, through an angle of about 270°, such that the strip of plastic film 4 will be brought to a temperature of about 200° C. when the assembly leaves the heating drum 7. At the output of the heating drum 7, the strip of plastic film adheres, because of its fusion, to the temporary support strip 3 which ensures dimensional stability to said strip of plastic film 4, the assembly thus forming a composite strip 18 whose two layers are temporarily stuck together.

Said composite strip 18 is carried horizontally downstream of the heating drum 7 toward a thermoprinting machine 8. This thermoprinting machine 8 comprises at its input a guide roller 9 against which bears the temporary support of the composite strip. Then, the composite strip is conveyed by a conveyor belt 10 about a rotatable heating calender 11 which is driven in rotation in the counterclockwise direction in FIG. 1. The conveyor belt 10 is constituted by an endless strip which rolls about a plurality of rollers 12, certain of these rollers being displaceable to adjust the tension of the belt 10 and hence the pressure exerted by the belt 10 against the heating calender 11. The composite strip comes into contact with the conveyor belt 10 with its temporary support, to avoid any sticking between the plastic film and the belt.

The machine 8 moreover comprises at least one reel 13, for example two reels, from which is unrolled a strip 14 of paper pre-printed with the design constituted by a sublimable ink. The strip of pre-printed paper 14 is guided by a roller 15 upstream of the belt 10 and of the heating calender 11. The machine 8 comprises two other reels 16 arranged downstream of the heating calender 11 and of the conveyor belt 10, on which reels 16 is rolled up the paper 14, after the transfer by sublimation of the ink onto the plastic film of the composite strip. The pre-printed paper 14 is sandwiched between the heating calender 11 and the front of the plastic film of the composite strip which is pressed by the conveyor belt 10 against the heating calender 11. The design constituted by a sublimable ink is pre-printed on the side of the paper 14 which is adapted to come into contact with the front of the plastic film of the composite strip, so as to permit the transfer by sublimation. By way of example, the transfer by sublimation takes place about the heating calender 11, over an angular path of about 300°, at a temperature comprises between 180 and 230° C., under a regular pressure generally less than 40 kPa exerted by the conveyor belt 10, and for a duration of about 5 to 40 seconds.

When the plastic film used is non-flocked, the sublimable ink of the pre-printed paper 14 contains softening and anti-adhering agents, to avoid sticking of the pre-printed paper 14 onto the plastic film. On the other hand, when the plastic film has a flocked surface, adapted to be printed, it is not necessary to provide such agents.

The structure of the printing machine 8 will not be described in greater detail, because it is known per se. In this machine 8, there are provided two reels 13 and two reels 16 for the pre-printed paper 14, so as to avoid any interruption of the process, when one of the reels is completely empty, the other then taking over during replacement of the completely empty reel.

At the outlet of the machine 8, the composite printed strip 19 is brought to a cooling station 20 which comprises two rotating cylinders 21 and 22 vertically offset relative to each other. The upper cylinder 21 is driven in rotation in the clockwise direction, whilst the lower cylinder 22 is driven in the counterclockwise direction. In a manner known per se, each cylinder 21 or 22 comprises a double wall on its side wall, to permit circulating within this double wall water, for example at 10° C., so as to cool the composite printed strip 19, to a temperature generally comprised between 20 and 30° C.

The composite strip passes first about the upper cylinder 21, coming into contact with its temporary support, so as to avoid the sticking of the printed plastic film against this cylinder. Then, the composite strip already cooled passes about the lower cylinder 22, with its printed plastic film in contact therewith, which no longer is in danger of sticking to the cylinder 22. The path of the composite strip about the two cylinders 21 and 22 has a substantially S shape. At the output of the cooling station 20, the previously printed plastic film no longer adheres to the temporary support strip, because of the anti-adherent properties of this latter.

Finally, the two superposed strips pass through a winding station 23 which comprises a reel 24 about which is rolled up the strip of printed plastic film 104 and a reel 25 about which is rolled up the strip of temporary support 3. At the inlet of the rolling up station 23, the two superposed strips 3 and 104 pass between two rollers 27 downstream of which the two strips are separated in the direction of their respective reel. The reels 24 and 25 and the rollers 27 are driven in rotation.

The operation of the device of FIG. 1 will now be briefly described.

The temporary support strip 3 is first unrolled from the reel 2 over all the path of the interior of the device up to the rolling up reel 25, over a total length of about 20 to 30 meters. Then, the strip 4 of plastic film is unrolled from the reel 17, for a length of about 2 to 3 meters up to the heating drum 7, because from this place the strip of plastic film 4 adheres to the temporary support strip 3, which permits its driving through all of the device. It should be noted that the temporary support strip 3 which is rolled up on the reel 25, could be reused for further printing of the new strip of plastic film.

Figure 2:
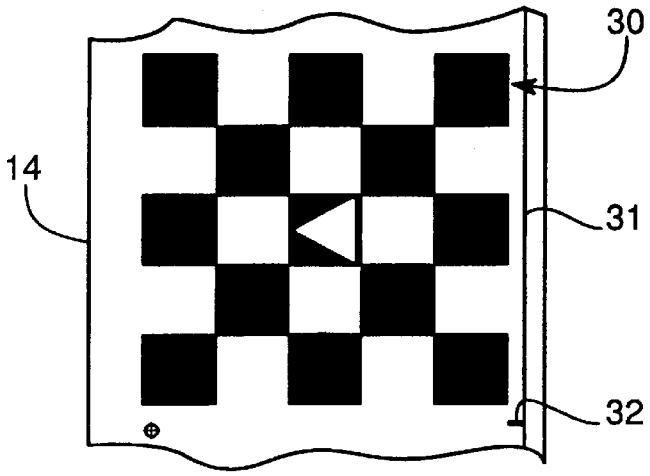
FIG. 2 is a fragmentary plan view of a strip of pre-printed paper with a reverse design, colored or not, constituted by a sublimable ink, adapted to be used in the process according to the first object of the invention.

In FIG. 2, a checkerboard design 30 is pre-printed on the strip 14 of printing paper, the checkerboard 30 comprising in its central square an equilateral triangle whose summit is directed to the left. On this strip of pre-printed paper 14 is also printed a reference numeral constituted by a longitudinal line 31 and a transverse dash 32, to locate on said strip 14 the pre-printed design 30.

Figure 3:
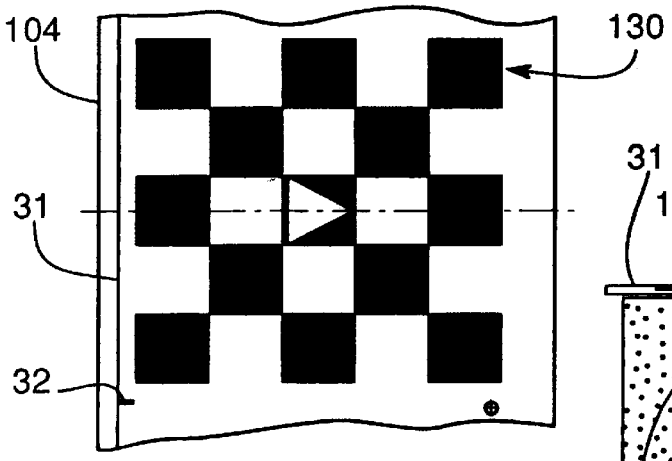
FIG. 3 is a fragmentary plan view of a strip of plastic film printed by transfer by sublimation from the pre-printed paper strip of FIG. 2.

With the device shown in FIG. 1, there can be obtained at the outlet a strip of flat plastic printed film 104 comprising a checkerboard 130 which is exactly the reverse image of the design 30 of the pre-printed paper 14, the summit of the equilateral triangle being in this case turned toward the right in FIG. 3.

Figure 4:
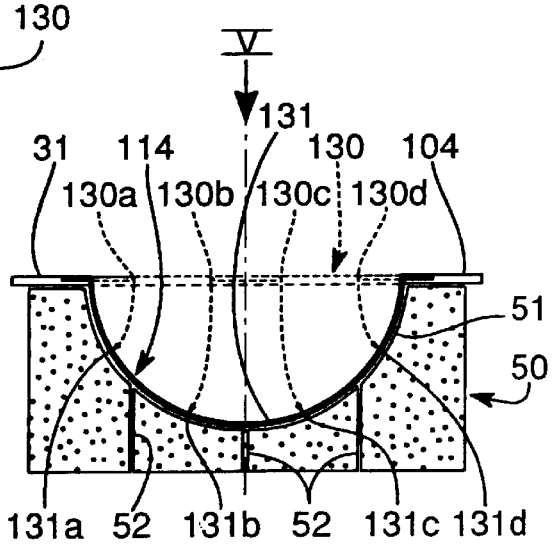
FIG. 4 is a view in transverse cross-section on the line IV of FIG. 5, showing the thermoforming of the printed strip of plastic film of FIG. 3 in a thermoforming tool with a spherical cavity.
Figure 5:
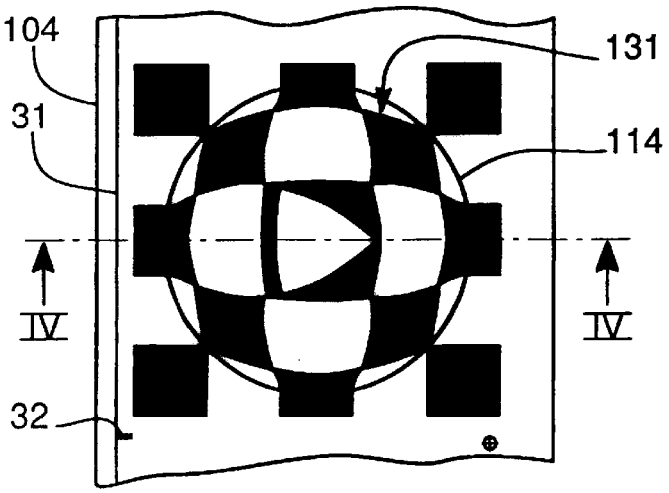
FIG. 5 is a fragmentary plan view in the direction of the arrow V on FIG. 4, showing the strip of thermoformed plastic film with a deformed design on its spherical surface.

In FIG. 4, there is shown the step of thermoforming a portion of this strip of printed plastic film 104, in a thermoforming tool 50 comprising a spherical cavity 51 and holes 52 connected to a source of external suction, which permits pressing the plastic film 104 softened by heating against the walls of the tool 50, this thermoforming tool being known per se. We have not shown the heating die, whose shape can be complementary to the cavity 51. A flat portion of the plastic film strip 104 is heated, then thermoformed to a non-planar spherical surface 114 by the thermoforming tool 50, this deformation giving rise to stretching of the checkerboard design 131, as shown in FIG. 5.

There is indicated in FIG. 4 by broken arrows the transformation of several elementary zones 130*a* to 130*d* of the flat plastic film into deformed elementary regions 131*a* to 131*d* on the thermoformed spherical surface 114. The assembly of the deformed elementary regions thus forms the deformed design 131 visible in FIG. 5.

Figure 6:
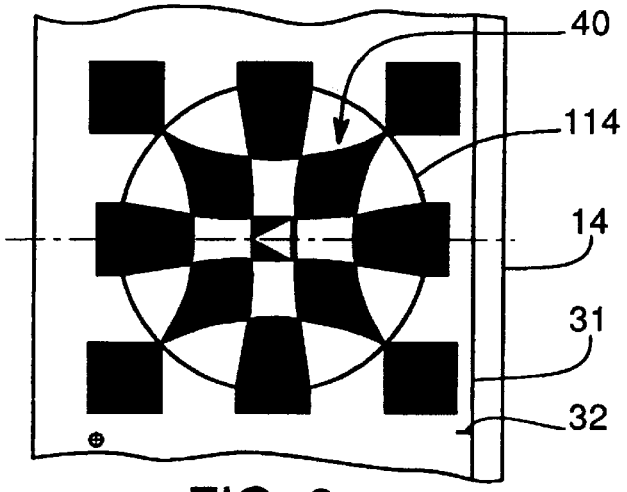
FIGS. 6 and 7 are views similar to FIGS. 2 and 3 respectively, but with a pre-deformed design for thermoforming, according to the second object of the invention.

To compensate for this undesirable deformation of the design before it appears on the thermoformed portion of the plastic film, there is determined, by reverse transformation, by anamorphosis, the pre-deformed design 40 which is pre-printed in reverse on a portion 114 of the printing paper 14, this portion 114 corresponding to the portion adapted to be thermoformed, as shown in FIG. 6. This deformation is calculated by a computer with the help of suitable software.

Figure 7:
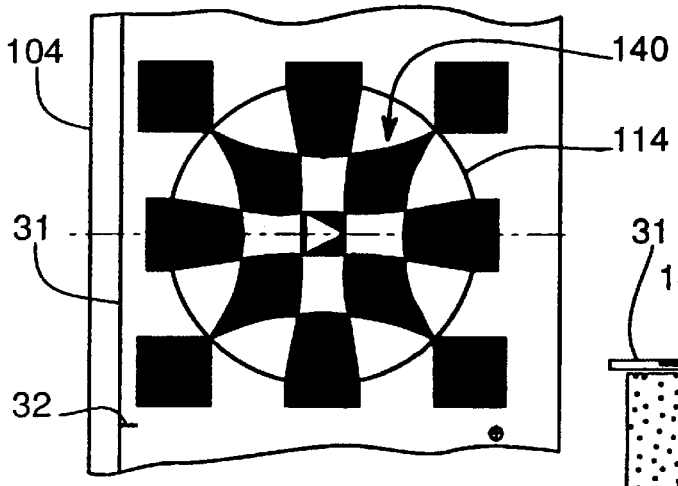

The strip of plastic film 104 is printed with pre-deformed design 140 by transfer by sublimation of the pre-deformed design 40 of the printing paper 14, as seen in FIG. 7.

Figure 8:
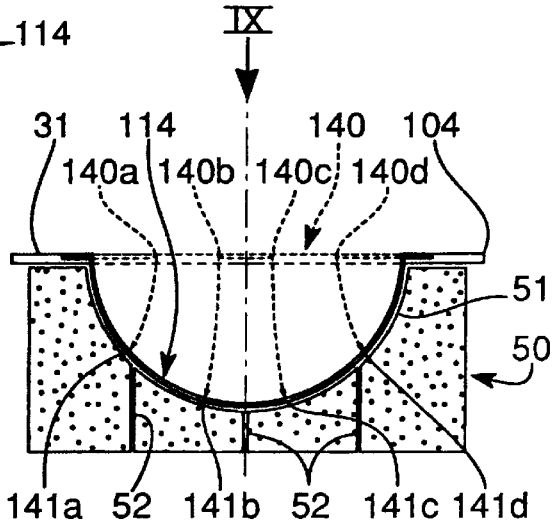
FIGS. 8 and 9 are views similar to FIGS. 4 and 5 respectively, with a non-deformed design on the thermoformed strip of plastic film.
Figure 9:
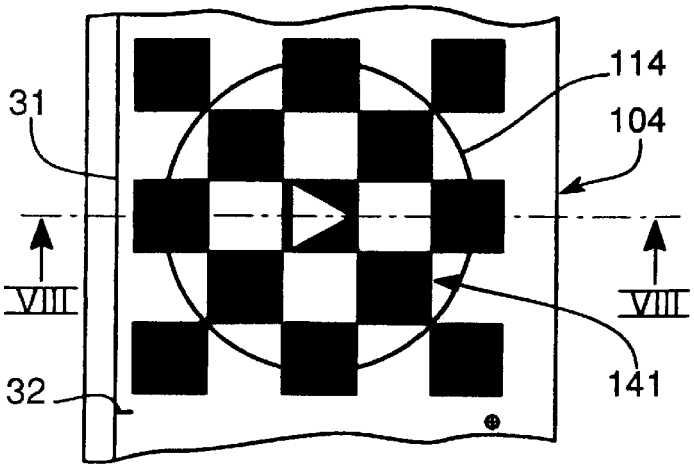

During thermoforming of the portion 114, sa shown in FIG. 8, each elementary region 140*a* to 140*d* of the flat portion of the plastic film is transformed into an elementary region 141*a* to 141*d* on the non-planar surface 114 obtained by thermoforming, as indicated by the broken arrows in FIG. 8.

There is thus obtained on the portion 114 of the strip of thermoformed plastic film, a design 141 which corresponds to the desired design, without final deformation.

During the step of thermoforming of the strip of printed plastic film 104, said strip is brought sequentially above the thermoforming cavity 51, so as to position precisely the portion 114 to be thermoformed above said cavity 51. The precise positioning of the portion 114 is obtained by optically reading the longitudinal and transverse position of this portion 14, with the help of the mentioned reference marks 31 and 32.

Although not shown in the drawings, the deformation by thermoforming of the portion 114 is also accompanied by a variation in the shades of color as a function of the extent of local stretching of the plastic film, which also requires pre-compensating these color variations, during the pre-printing of the printing paper 14.

Although the invention has been described in connection with a particular embodiment, it is of course evident that it is not in any way limited and that it comprises all the technical equivalents of the described means as well as their combinations if these enter into the scope of the invention.

What is claimed is:

1. Process for the continuous printing of a plastic film (4), flocked or not, comprising the steps of:

applying on a back side of a continuously moving strip of plastic film (4) a strip of temporary anti-adhering support (3), made of a material that has little sensitivity to heat, while the plastic film strip is continuously moving with the temporary support strip applied to the back side of the plastic film strip, heating the assembly of the continuously moving plastic film strip and the temporary support strip to a temperature such that the plastic film reaches its softening point to stick temporarily the plastic film strip to the temporary support strip, such that said temporary support strip ensures the dimensional stability of the plastic film strip during a succeeding thermal printing step, while the plastic film strip thermo-stuck to the temporary support strip is continuously moving, applying a strip of paper (14) pre-printed with a design (30, 40) constituted by a sublimable ink to a front side of the continuously moving plastic film strip, and thermo-printing said plastic film strip thermo-stuck to the temporary support strip by transferring by sublimation said design (30, 40) under predetermined temperature and pressure from the pre-printed paper strip to the front side of the continuously moving plastic film strip (4) thermo-stuck to the temporary support (3), so as to provide a continuously moving thermo-printed plastic film strip thermo-stuck to the temporary support strip, separating the pre-printed paper strip from the continuously moving thermo-printed plastic film strip thermo-stuck to the temporary support strip, cooling the assembly of the continuously moving thermo-printed plastic film strip and the temporary support strip (3) to a temperature permitting unsticking of the temporary support strip from the continuously moving thermo-printed plastic film strip to provide a thermo-printed plastic film strip (104).

2. Process according to claim 1, wherein the temperature to thermo-stick the plastic film strip (4) to the temporary support strip (3) is between 100 to 200° C.

3. Process according to claim 2, wherein said temperature is between 170 and 180° C.

4. Process according to claim 1, wherein the temperature for the transfer by sublimation is between 170 and 230° C.

5. Process according to claim 1, wherein the temperature to which the assembly of the printed plastic film strip (104) and the temporary support strip (3) is cooled is of the order of 20 to 30° C.

6. Process according to claim 1, further comprising, for a non-flocked plastic film, the step of pre-printing the paper strip (14) with an ink containing sublimable coloring agents, and a low content of softening or anti-adherent agents, to avoid sticking between the plastic film strip (4) and the paper strip (14), during the step of printing by transfer by sublimation.

7. Process according to claim 6, wherein the agents are selected from silicones, organic fatty acids and chromium stearates.

8. Process according to claim 1, further comprising the steps of preparing a flocked plastic film strip, by applying on the front side of the plastic film strip (4) an adhesive layer and by flocking fibers of white color onto said adhesive layer.

9. Processing according to claim 8, wherein the adhesive layer is a polymer resin in aqueous emulsion or in organic solution, and the fibers are fibers of polyamide or polyester, with a length comprised between 0.3 and 3.0 mm and a titre comprised between 0.5 and 20 Dtex (0.5 and $20.10^{-7}$ $Kg.m^{-1}$).

10. Process according to claim 1, wherein the plastic film (4) is a calendered film, extruded or co-extruded, made from polymeric resins selected in the group consisting of polyvinyl chloride, polystyrene, polypropylene, acrylic butyl styrene (ABS), polyurethane, polyester, polycarbonate, polyamide or any mixture thereof.

11. A strip of printed plastic film, directly obtained by the process according to claim 1.

12. Device for continuous printing of a plastic film, comprising:

an unwinding station (1), comprising a reel (17) for a strip of plastic film (4), flocked or not, and a reel (2) for a strip of temporary support (3), a heating station (5) comprising a rotatable driven heating drum (7), at an entry of which the temporary support strip (3) is applied against a back side of the strip of plastic film (4) so as to superpose said temporary support strip and plastic film strip, the assembly constituted by said superposed strips passing about the heating drum with the temporary support strip being in contact with said heating drum, so as to deliver at an outlet of said heating station a composite strip (18) constituted of the plastic film strip thermo-stuck to the temporary support strip, a thermoprinting machine (8), comprising a conveyor belt (10) under tension which comes into contact with the temporary support strip (3) of said composite strip (18), a heating calender (11) driven in rotation, and at least one reel (13) for a strip of paper (14) pre-printed with a design (30, 40) constituted by a sublimable ink, said strip of pre-printed paper being applied to a front side of the plastic film strip (4) of said composite strip (18), upstream of the heating calender, the conveyor belt pressing with a predetermined pressure said composite strip covered with said pre-printed paper strip against the heating calender, to transfer by sublimation the sublimable ink onto the front side of the plastic film strip to obtain a composite printed strip (19) made of a printed plastic film strip stuck to the temporary support strip, the pre-printed paper strip being separated from the composite printed strip (19) downstream of the heating calender, a cooling station (20) to cool the composite printed strip (19) to a temperature such that the temporary support strip (3) can be unstuck from the printed plastic film strip (104), a winding up station (23) comprising rotably driven take-up reels (24, 25), at an inlet of which the temporary support strip (3) is unstuck from the printed plastic film strip (104), each of said temporary support strip and printed plastic film strip being wound up on a respective one of said take-up reels (24, 25).

13. Device according to claim 12, wherein the cooling station (20) comprises two cylinders (21, 22) with double walls, each cylinder being cooled by a cooling agent circulating between the double walls, said two cylinders being arranged in succession such that said printed composite strip (19) comes first into contact with a first one of said cylinders through the temporary support strip (3), then with a second one of said cylinders through the printed plastic film strip (104).

* * * * *